United States Patent [19]

Holden

[11] Patent Number: 4,576,021

[45] Date of Patent: Mar. 18, 1986

[54] TRAILER LOCK

[75] Inventor: Kenneth M. Holden, Zephyr Cove, Nev.

[73] Assignee: 501 W B Lock Company, Stateline, Nev.

[21] Appl. No.: 483,824

[22] Filed: Apr. 11, 1983

[51] Int. Cl.[4] ..... E05B 67/36

[52] U.S. Cl. ..... 70/34; 411/351; 411/353; 411/517

[58] Field of Search ..... 70/31–34, 70/23, 28, 42, DIG. 69; 411/517, 521, 530, 351–353, 347; 292/183

[56] References Cited

U.S. PATENT DOCUMENTS

| | | | |
|---|---|---|---|
| 233,255 | 10/1880 | Kimble | 411/352 X |
| 834,591 | 10/1906 | Streams | 70/32 |
| 1,546,021 | 7/1925 | Parmele | 70/32 |
| 1,744,984 | 1/1930 | Page | 70/34 |
| 2,677,261 | 5/1954 | Jacobi | 70/32 |

FOREIGN PATENT DOCUMENTS

| | | | |
|---|---|---|---|
| 2425386 | 12/1975 | Fed. Rep. of Germany | 70/34 |
| 411112 | 6/1945 | Italy | 70/31 |

*Primary Examiner*—Robert L. Wolfe
*Assistant Examiner*—Lloyd A. Gall
*Attorney, Agent, or Firm*—Poms, Smith, Lande & Rose

[57] ABSTRACT

A lock including an elongate member which is inserted into a lock housing, useful in locking structural frame members together, among other things.

3 Claims, 10 Drawing Figures

TRAILER LOCK

BACKGROUND OF THE INVENTION

1. Field of the Invention

This invention relates to locks, and more particularly to locks useful for locking structural members together.

2. Description of the Prior Art

The prior art contains many types of locks which have their own particular application. For example, hasps and padlocks have been used to lock cabinets and doors; and chains and padlocks have been used to connect separate frame members via apertured-brackets. However, all of these locks have suffered from the same failures, that being that use of conventional padlocks expose vulnerable and relatively weak elements which can be sawed through, gripped or broken off.

However, there has not been any prior art locks which combine the features and advantages of the invention to be described herein.

It is the primary object of this invention to provide a novel lock.

It is another object of this invention to provide a novel lock which serves as a bolt to connect different elements and which also locks the elements together.

A further object of the invention is to provide a novel lock which can replace the conventional hasp and padlock, and conventional chain and padlock.

Yet another object of this invention is to provide a lock which is difficult to saw through, grip, or break.

Further objects and advatages of this invention will become apparent to those skilled in the art from the following description.

SUMMARY OF THE INVENTION

Briefly, the above and other objects are provided by a lock including an elongate member having a movement limiting means on one end for limiting the axial movement of the member in one direction and an inserting means on the second end for being slideably inserted into a lock housing, and having a lock housing with a means for lockingly receiving the inserting means on the second end of the elongate member and with a means for limiting the axial movement of the elongate member in the other direction.

In a preferred lock, the inserting means comprises a uniformly cross-sectioned longitudinal portion having a recess in a portion of the inserting means. It is also preferred that this recess extend around the circumference of the elongate member, thereby being an annular recess. It is further preferred that the second end of the elongate member, that is, the end having the inserting means, be tapered to facilitate insertion.

In the above preferred lock, the receiving means has an elongate opening adapted to receive the inserting means and a locking means for locking the elongate member in the elongate opening. It is preferable that the locking means include a lock mechanism and a pin means operably-connected with the lock mechanism for extending into and withdrawing from the recess.

Another embodiment of this invention provides that the elongate member has an annular recess as part of its inserting means and a loose-fitting annular ring sized to be retained within said annular recess. The elongate opening has a recessed portion opposite the pin means designed to receive the annular ring when pushed into the recessed portion by the pin means. This provides that the annular ring as well as the pin means lockingly retains the elongate member in the elongate opening.

BRIEF DESCRIPTION OF THE DRAWINGS

The invention will now be described in more detail, by having reference to the following drawings, wherein.

DETAILED DESCRIPTION OF THE INVENTION

Figure 1:
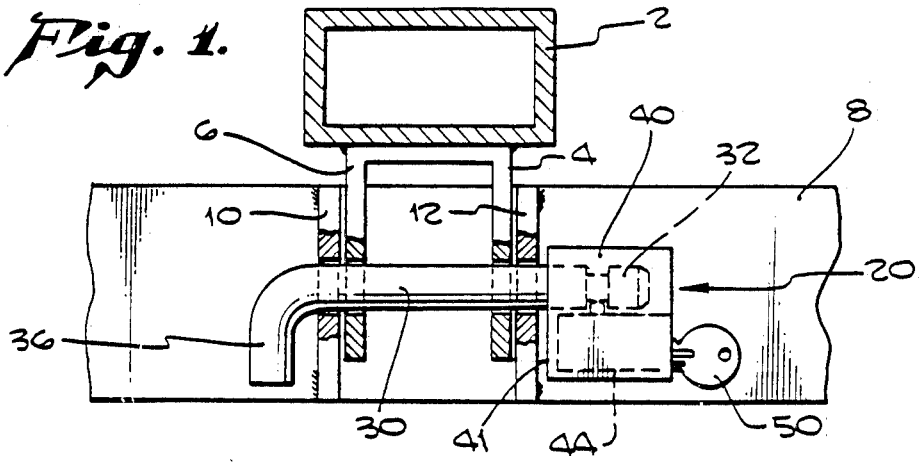
FIG. 1 is a view of the lock of this invention showing its use in locking a trailer to the frame of a motor vehicle.

Turning now to FIG. 1, there is shown a useful application of the lock of this invention. Lock 20 is used to lock a trailer hitch frame member 2, shown in cross-section, having apertured mounting brackets 4 and 6, to an automobile bumper 8 having apertured bumper brackets 10 and 12. The bumper brackets and the mounting brackets are provided with wholes that can be aligned so as to receive a removable bolt 30 on the lock 20 of this invention. The lock 20 comprises a bolt 30, and a lock housing 40.

The bolt 30 serves as the elongate member and includes at one end a means 32 for inserting into the lock housing 40, and at the other end a means 36 for limiting the axial movement of the bolt (i.e., preventing the bolt from being pulled to the right). In FIG. 1, the axial movement limiting means is a terminal curved portion 36 in the bolt 30 which prevents the bolt 30 from being pulled through the brackets in a rightward direction. In an alternative embodiment, a large circular head could be used on the end of the bolt 30 as the axial movement limiting means.

The lock housing 40 includes a receiving means for lockingly receiving the inserting means 32 of the bolt 30. The lock housing 40 also includes means for limiting the axial movement of the lock housing to the left so as to prevent withdrawal of the lock through the brackets. In this embodiment the axial movement limiting means is served by the transverse surface 41 of the housing 40.

Figure 2:
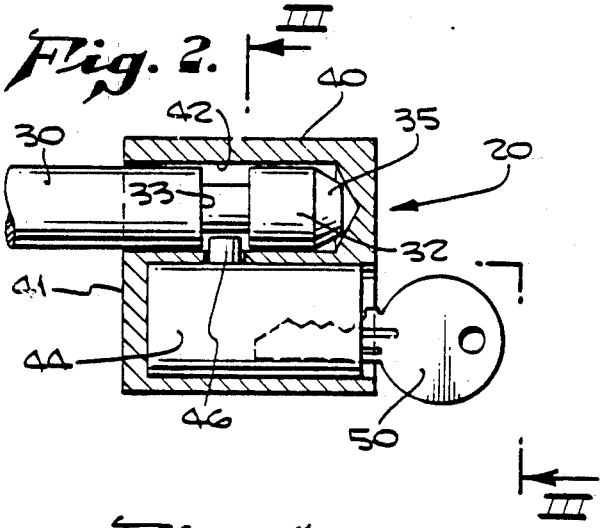
FIG. 2 is a side cross-sectional view of the lock in its locked condition.
Figure 3:
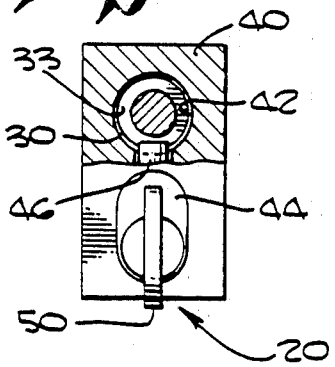
FIG. 3 is a front view of the lock shown in FIG. 2, partially in cross-section, taken along the line III—III.
Figure 4:
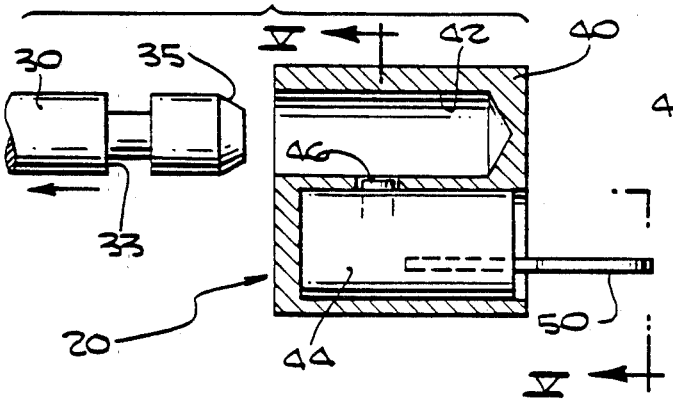
FIG. 4 is a side cross-sectional view of the lock shown in FIG. 2 wherein the key has unlocked the lock.
Figure 5:
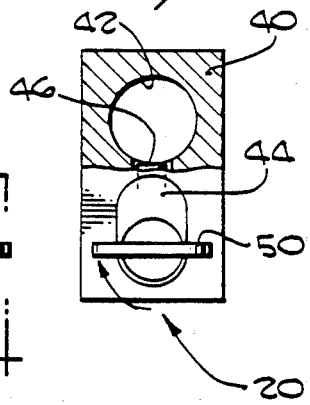
FIG. 5 is the front elevational view of the lock in FIG. 4, shown in partial cross-section along the line V—V of FIG. 4.

Referring now to FIG. 2, where the lock 20 is shown in more detail, lock housing 40 comprises an elongate opening 42 adpated to receive the inserting means 32 of the bolt 30. The inserting means 32 also includes a tapered end 35 to facilitate insertion of the bolt 30 in the elongate opening 42 of the lock housing 40.

The receiving means of the lock housing 40 also includes a lock mechanism 44, having a lock pin 46. The lock mechanism 44 may be any conventional lock mechanism, such as a key-operated lock mechanism. The pin 46 is designed to extend into the elongate opening 42 from the lock housing 40 so as to limit the axial movement of the bolt 30 and thereby lock the bolt in the lock housing. The lock pin 46 is normally in the extended position when the lock is in the locked condition. The lock 20 is unlocked by turning the key 50 which causes the lock pin 46 to be withdrawn into the lock housing 40 which thereby allows the bolt 30 to be withdrawn from the lock housing 40.

The lock pin 46 can function in any conventional manner. For example, the lock pin can be biased inwardly by a spring in the lock mechanism when in the locked position. This would allow the bolt 30 to be inserted into the elongate opening 42 and via the tapered end 35 slidably depress the lock pin 46 until the lock pin is freed by the annular recess 33 and again becomes fully-extended as a result of the biasing force. Another embodiment of the lock pin would have the lock pin rigidly extended in the locked position and be only movable up or down by turning the key. This embodiment would require the key 50 to be turned to withdraw the lock pin 46 so that the bolt 30 could be inserted and then require the key to be turned to the locked position to extend the lock pin 46 in the annular recess 33 in order to lock the lock 20.

Referring now to FIGS. 6–9, there is shown another embodiment of the lock shown in FIGS. 1–5. The lock 120 is identical in all respects to lock 20, except for the construction of the elongate opening 142 and the addition of another element to the receiving means.

Figure 6:
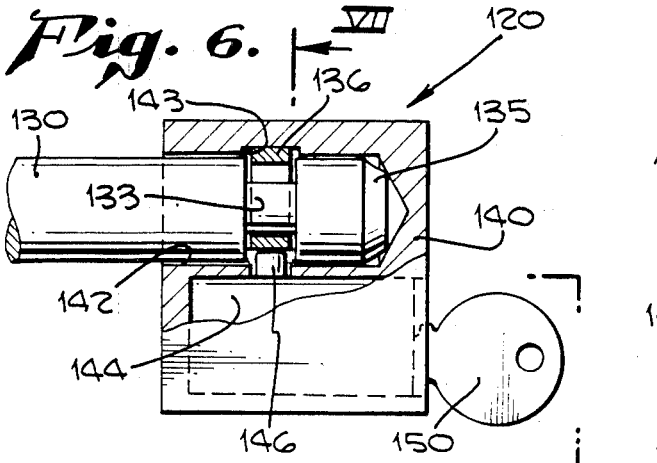
FIG. 6 is a side cross-sectional view of another embodiment of this invention, shown in a locked condition.
Figure 7:
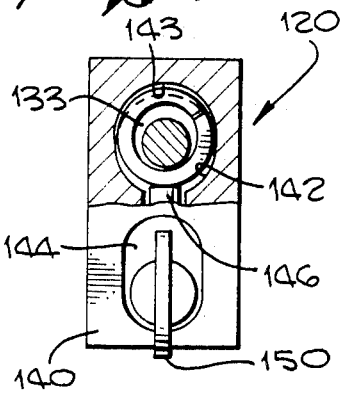
FIG. 7 is the front view of the lock in FIG. 6, shown in partial cross-section along the line VII—VII.

Referring to FIG. 6, bolt 130 includes bolt annular recess 133, and an annular ring 136. Annular ring 136 is designed to be loosely retained within the recess 133. The elongate opening 142 is provided with an elongate opening recess 143 which is located adjacent to the pin 146.

Figure 8:
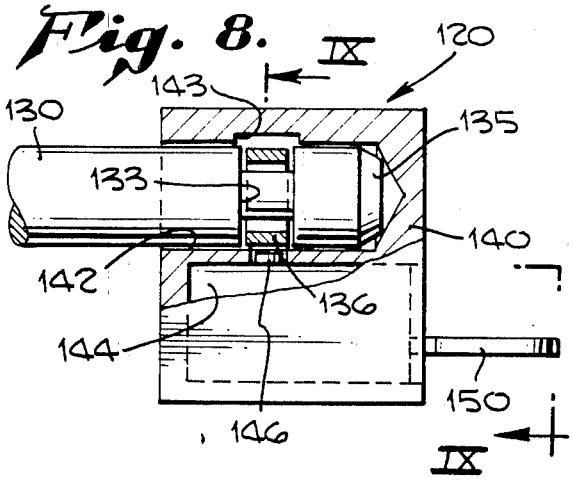
FIG. 8 is a side cross-sectional view of the lock in FIG. 6 shown with the key turned to unlock the lock.
Figure 9:
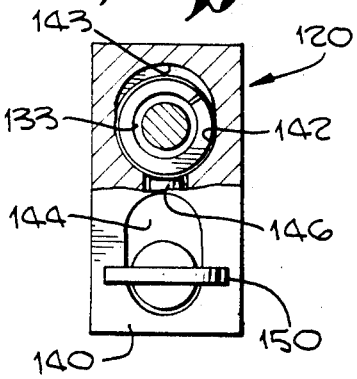
FIG. 9 is the front view of the lock shown in FIG. 8, in partial cross section taken along the line IX—IX.

The pin 146, the bolt annular recess 133, the elongate opening recess 143, and the annular ring 136 cooperate in the following manner. The annular ring 136 is sized to have a diameter approximately equal to the diameter of the bolt 130, and it should not be larger than the diameter of the opening 142. This will allow the bolt 130 to be inserted into the opening in the manner described for lock 20, as shown in FIG. 8.

However, once the bolt is fully inserted and placed in the locking position as shown in FIG. 6, the pin 146 extends into the recess 133 and meets the ring 136. The pin should be sized so that it pushes the ring up into the recess 143. The annulus of the ring 136 must be large enough to allow this movement of the ring. When in the locked condition shown in FIG. 6, the bolt 130 is more firmly retained in the housing because now the annular ring 136 is positioned to engage the walls of the housing annular recess 143 if the bolt is pulled to the left in an attempt to open the lock. In this construction, both the pin 146 and the annular ring 136 serve to lock the bolt 130 in the lock housing 140.

When it is desired to unlock the lock 120, the key 150 is turned to the unlocked position, and the lock mechanism 144 moves the pin 146 to the unlocked position (FIG. 8), the annular ring 136 drops into alignment with the bolt 130 and the bolt can then be removed. It is apparent that because the realignment of the ring 136 is gravity controlled, the lock housing should be properly positioned to allow the ring to fall into its withdrawal position.

Figure 10:
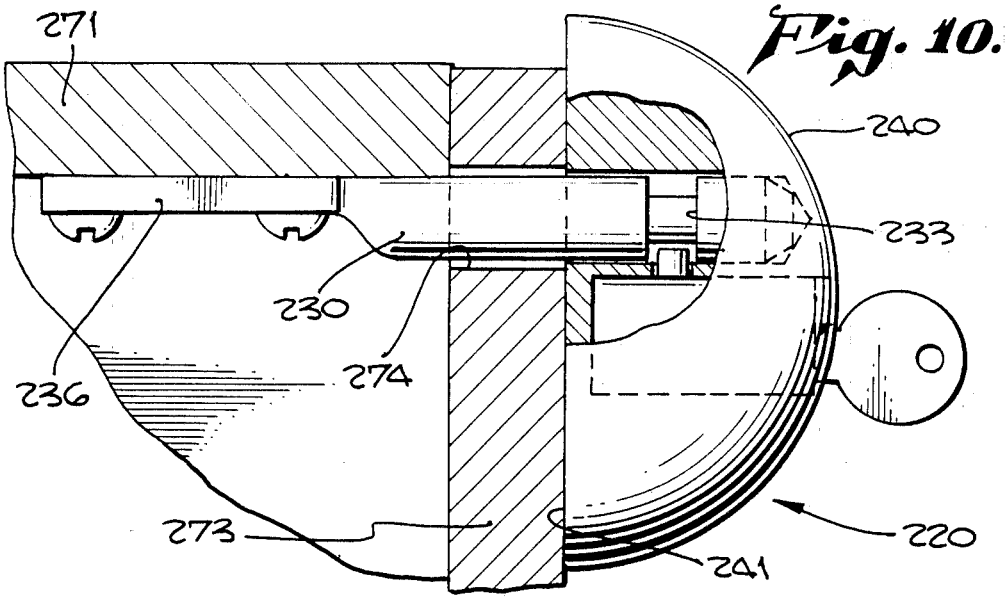
FIG. 10 is a side, partial cross-sectional view of another embodiment of this invention wherein the lock is used to lock a cabient door and having a hemispherical lock housing.

Referring now to FIG. 10, there is shown another embodiment of the lock of this invention. Lock 220 is shown being used to lock the door of a cabinet or other similar thing. The cabinet comprises stationary side frame member 271 and cabinet door 273. Cabinet door 273 pivots about a hinge not shown in the drawing. A bolt 230 is shown fixedly attached to the side frame 271 by screws passing through portion 236 of the bolt. This portion 236 of the bolt 230, including the fastening means, serve as the axial movement limiting means of the bolt 230. The door 273 is provided with an opening 274 through which the bolt 230 can pass. The bolt 230 is designed so that the inserting means of the bolt 230 extends beyond the outer surface of the door 273.

The receiving means and the locking means of this lock can be constructed in any manner contemplated by this invention, such as shown in the embodiments described above. However, the lock housing of this embodiment does not have the conventional box-shape of typical lock housings. Rather, the lock housing 240 of this embodiment is substantially hemispherical. The utility of this shape is that it provides a large flat surface 241 adapted to flushly abut the surface of the door 273. This large surface 241 provides the axial movement limiting means to prevent the lock housing 240 from passing through the door opening 274. An additional benefit of the hemispherical shape is to provide an outer surface for the lock housing which is almost impossible to grab hold of with any tools, or to saw through. A further benefit is derived if the recess in the bolt is an annular recess, as is shown by 233; and that is that the lock housing can freely rotate about the bolt. In fact, this benefit is obtained in each of the embodiments disclosed, regardless of the shape of the lock housing. Free rotation of the lock housing makes grabbing or holding the lock even more difficult, thus discouraging tampering with the lock.

Many other embodiments of this invention are possible utilizing any shape desired for the lock housing. This is particularly desirable for locks used to lock cabinets, as is shown in FIG. 10, so as to be able to provide a decoratively-shaped housing to avoid the functional appearance of typical locks.

While there has been shown and described what is at present considered the best mode of practicing the invention, it is obvious to those skilled in the art that many other modes can be made without departing from the scope of the invention as defined in the following claims.

I claim:

1. A lock comprising:

an elongate member having a movement limiting means on one end for limiting the axial movement of the member in one direction and an inserting means on the second end for being slidably inserted into a lock housing; and a lock housing having a means for lockingly receiving the inserting means on the second end of the elongate member, and a means for limiting the axial movement of the elongate member in the other direction;

wherein said receiving means comprises:

an elongate opening adapted to receive the inserting means of the elongate member;

means for locking the elongate member in the elongate opening, said locking means including:

a first annular recess in the inserting means;

an annular ring loosely retained within said first annular recess;

a second recess disposed in the elongate opening so as to be adjacent the annular ring when the elongate member is inserted; and movable means associated with the lock housing for extending into the first annular recess and moving the annular ring into the second recess to lock the elongate member in the elongate opening and for withdrawing from said first recess to allow the elongate member to be withdrawn from the elongate opening.

2. The lock defined in claim 1 wherein the lock housing is substantially hemispherical and wherein the elongate opening extends substantially perpendicular into the flat face of the hemispherical lock housing.

3. The lock defined in claim 1 wherein the axial limiting means of the elongate member is a curved longitudinal section.

* * * * *